US009487321B2

(12) United States Patent
Luke

(10) Patent No.: US 9,487,321 B2
(45) Date of Patent: Nov. 8, 2016

(54) PRODUCT DISPLAY TOWER WITH SUPPORT BASE THAT FOLDS FLAT FOR SHIPPING

(71) Applicant: INTERNATIONAL PAPER COMPANY, Memphis, TN (US)

(72) Inventor: William B. Luke, Fort Mill, SC (US)

(73) Assignee: International Paper Company, Memphis, TN (US)

( * ) Notice: Subject to any disclaimer, the term of this patent is extended or adjusted under 35 U.S.C. 154(b) by 147 days.

(21) Appl. No.: 14/547,598

(22) Filed: Nov. 19, 2014

(65) Prior Publication Data

US 2015/0144525 A1 May 28, 2015

Related U.S. Application Data

(60) Provisional application No. 61/909,026, filed on Nov. 26, 2013.

(51) Int. Cl.

| | |
|---|---|
| ***B65D 5/50*** | (2006.01) |
| ***B65D 5/52*** | (2006.01) |
| ***A47F 5/11*** | (2006.01) |

(52) U.S. Cl.

CPC ..... *B65D 5/5253* (2013.01); *A47F 5/116* (2013.01); *B65D 5/52* (2013.01)

(58) Field of Classification Search

CPC .... A47B 91/00; A47B 91/005; A47B 43/02; A47B 47/02; A47B 55/06; A47B 61/06; A47F 5/112; A47F 5/114; A47F 5/116; A47F 5/118; A47F 5/11; B65D 5/5253; B65D 5/52

USPC ..... 206/764, 736, 740, 765, 425; 211/36, 211/85, 153, 135, 186, 42, 72, 73; 248/188.1, 188.8, 127; 220/481

See application file for complete search history.

(56) References Cited

U.S. PATENT DOCUMENTS

| | | | | |
|---|---|---|---|---|
| 5,000,329 | A * | 3/1991 | Luberto | A47F 5/11 211/132.1 |
| 5,315,936 | A * | 5/1994 | Smith | A47F 5/116 108/165 |
| 5,826,732 | A * | 10/1998 | Ragsdale | A47F 5/116 108/165 |
| 7,134,230 | B1 * | 11/2006 | Boens | G09F 1/06 40/124.07 |
| 8,375,858 | B2 * | 2/2013 | Steadman, Sr. | F42B 4/20 102/343 |
| 2012/0305512 | A1 * | 12/2012 | L'Hotel | A47F 5/116 211/198 |

* cited by examiner

*Primary Examiner* — Jacob K Ackun
*Assistant Examiner* — Rafael Ortiz
(74) *Attorney, Agent, or Firm* — Matthew M. Eslami

(57) ABSTRACT

A shipping and display container comprises an elongate display tower having an upper end, a lower end, a plurality of vertically spaced shelves, and a stabilizing base attached on the lower end to stabilize the tower in an upright position. The base has a first position folded against the tower so that the base has a small footprint for shipping, and a second position unfolded to a larger footprint to define a support for stabilizing the tower in an upright position. The base is in two separate base parts attached to respective opposite sides of the lower end of the tower. Triangularly shaped fins extend outwardly from opposite side edges of each base part so that a fin extends diagonally outwardly from opposite corners of the tower. The fins are foldable to the first position and unfolded to the second position.

12 Claims, 17 Drawing Sheets

PRODUCT DISPLAY TOWER WITH SUPPORT BASE THAT FOLDS FLAT FOR SHIPPING

FIELD OF THE INVENTION

This invention relates generally to display racks for supporting and displaying articles at a point of purchase, and more particularly to a recyclable free-standing display tower made of interlocking panels of fiber-based material such as containerboard and having a plurality of vertically spaced shelves mounted on a frame that has a support base which can be folded into a compact position for shipping and unfolded to a laterally expanded position to stabilize the display tower when it is in use.

BACKGROUND OF THE INVENTION

Many products for sale to the general public are commonly supported and displayed at the point of purchase on free-standing racks placed in prominent locations for maximum visibility and easy access to the product. Graphics are commonly applied to the racks to enhance visual attraction to the displayed product. These racks must be of sturdy construction to support the weight of the displayed product and to withstand the rigors of use in a retail environment. Accordingly, conventional racks of this type are typically constructed from permanent display materials such as wood, metal, and/or plastics. These displays are fairly costly to manufacture and ship, making them expensive to purchase and to deploy through direct store delivery (DSD) systems. If they are shipped unassembled, substantial labor and the use of tools is generally required to erect them at the point of purchase. Further, they are not easily recyclable and are never or rarely recycled, ending up instead in landfills.

The practice of displaying goods in the containers used to ship them has become more popular, particular with the advent of large warehouse style stores and supermarkets. These dual purpose shipping and display containers typically are made of paper materials such as corrugated paperboard and many of them are designed to be supported directly on the retail floor.

Those display containers that are designed to be supported directly on the retail floor preferably are free standing. One such free standing display container comprises an elongate, relatively narrow tower fitted at its lower end in a pocket in an outwardly flared pyramid shaped base to help stabilize the tower in an upright position. A display tower of this type currently is used in store aisles to hold certain products for a temporary period of time. However, corrugated materials can change in nature and strength if the fluting becomes stressed, which would then change the original fit of the display in the base that is needed for stability. Thus, the pyramid shaped base, over time, becomes loose due to movement or consumer handling. Accordingly, it has been observed that some displays either lean or are fastened to other objects to prevent them from tipping over. This poses a challenge of how to attach the display to the base and still maintain stability without having to fasten the display to other objects.

Further, the previous display tower is filled with product and placed in an outer shipping container for shipment to a retail establishment. The shipping container must be sized to accommodate the pyramid shaped base. Since the base is laterally larger than the rest of the display tower, a void space is created around the entire bottom shelf area of the display, which then requires fillers to stabilize the unit during shipping. This leads to increased cost.

It would be desirable to have a shipping and display container with an enlarged base for providing stable support to the container on a retail floor, wherein the base can be folded into a compact position for shipping, thereby eliminating the need for fillers, and unfolded into an expanded position at the retail establishment.

SUMMARY OF THE INVENTION

The present invention is a shipping and display container with an enlarged base for providing stable support to the container on a retail floor, wherein the base can be folded into a compact position for shipping, thereby eliminating the need for fillers, and unfolded into an expanded position at the retail establishment.

The base of the invention is fastened to the bottom end of the display tower, rather than the bottom end of the tower being inserted into a pocket in the base as in the prior device. This provides a more secure arrangement that is not prone to becoming loose due to movement or consumer handling. The base has foldable fins that are folded flat against the side of the display tower during shipping and then once at retail are folded outwardly to stabilize the tower in an upright position. The fins extend diagonally outwardly from the corners of the bottom end of the display tower and do not apply the same pressure to the bottom end as the previous pyramid design. A stabilizer wire is connected with the fins to securely hold them in a spread position. The present invention makes the display more stable than the pyramid base previously used for this display.

The folding base eliminates the need for filler materials that were needed in the previous design to provide protection during shipping. This enables a smaller shipping carton to be used to ship the display tower and also enables a greater quantity to fit on a pallet. More displays per pallet means that the truck load quantity also increases.

The base and stabilizing wire length can easily be resized if the display is made larger or smaller to accommodate different product mixes and sizes. The wire location in relation to the base design would stay in an approximate location due to its stabilizing feature. The wire is put in place once the base is ready for display.

In a preferred construction the foldable stabilizing base comprises two parts, each made of a single piece of folded paperboard and one part being attached to each of two opposite sides of the display tower bottom end.

The display tower is made of a single piece of folded paperboard, and each of the shelves is also made of a single piece of folded paperboard. The shelves wrap around and capture inwardly folded tabs on opposite sides of the tower, and flaps on opposite sides of the tower are folded inwardly and capture depending flanges at opposite sides of each shelf, securely holding each shelf in position in the tower.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAIL DISCRIPTION OF THE INVENTION

Figure 1:
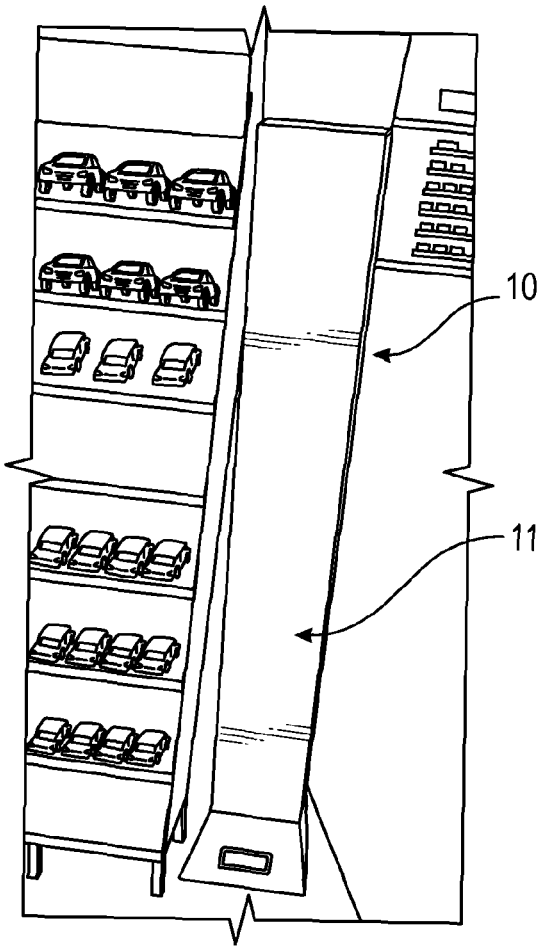
FIG. 1 (Prior Art)
FIG. 1 is an isometric view showing a prior display tower with a pyramid shaped base in use in a retail establishment.
Figure 2:
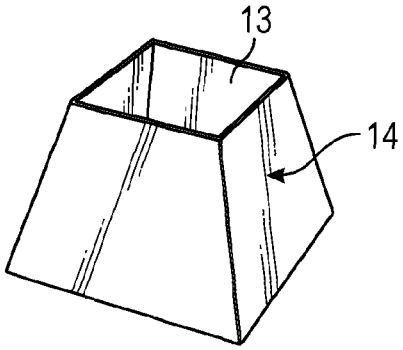
FIG. 2 (Prior Art)
FIG. 2 is a top isometric view of the pyramid shaped base of the prior display tower.
Figure 3:
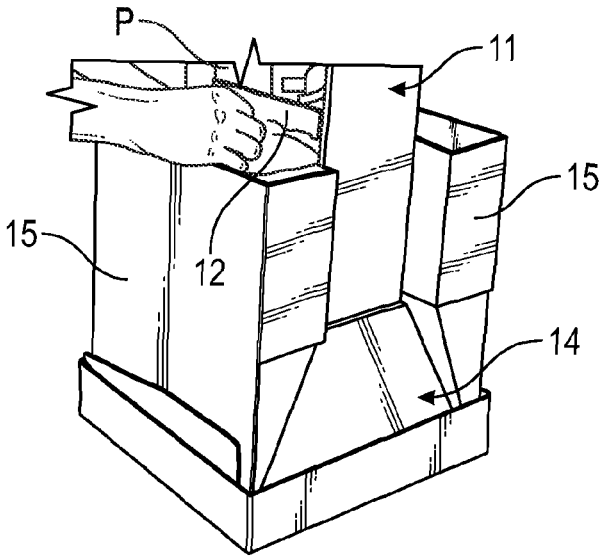
FIG. 3 (Prior Art)
FIG. 3 is a fragmentary enlarged isometric view depicting the fillers that must be used with the prior design.
Figure 38:
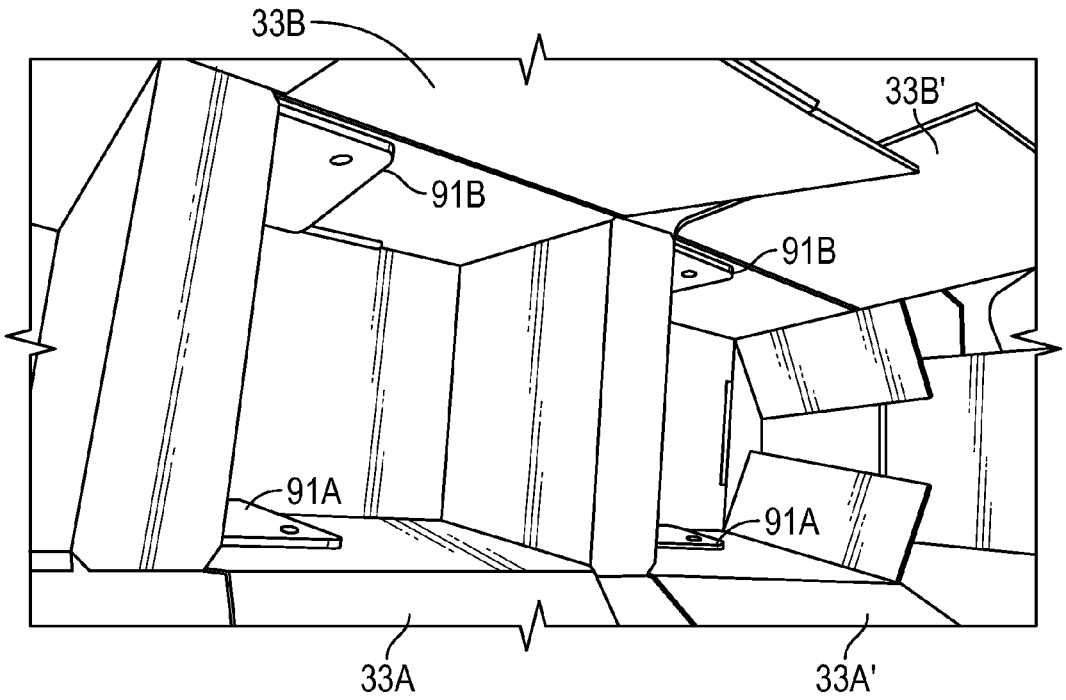
FIG. 38 shows the shelf fully folded over the tabs.
Figure 39:
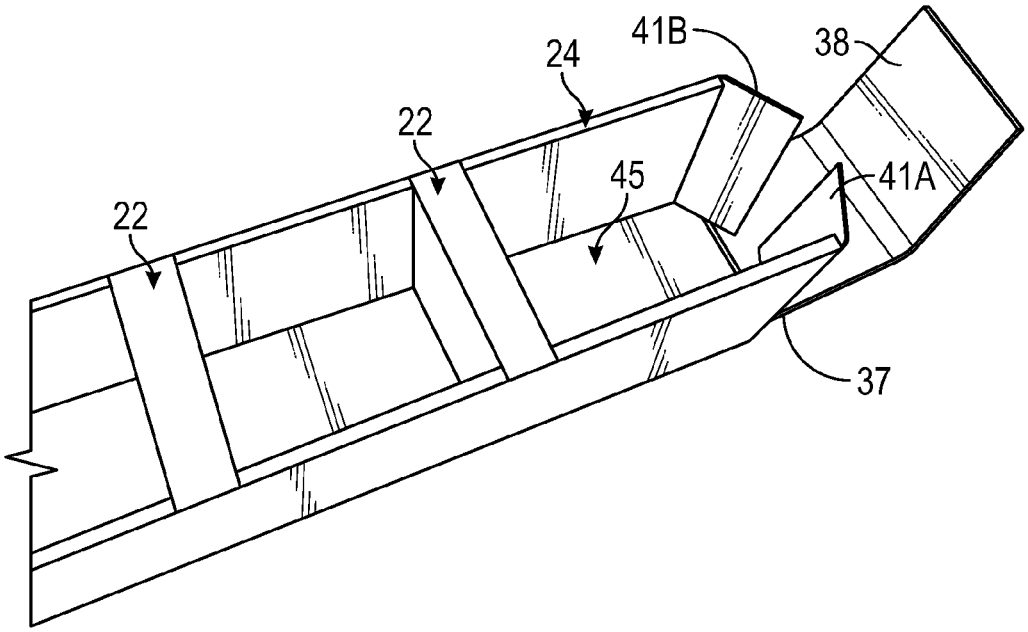
FIG. 39 shows the flaps on opposite sides of the tower folded inwardly over the downwardly folded flanges at opposite sides of the shelf
Figure 40:
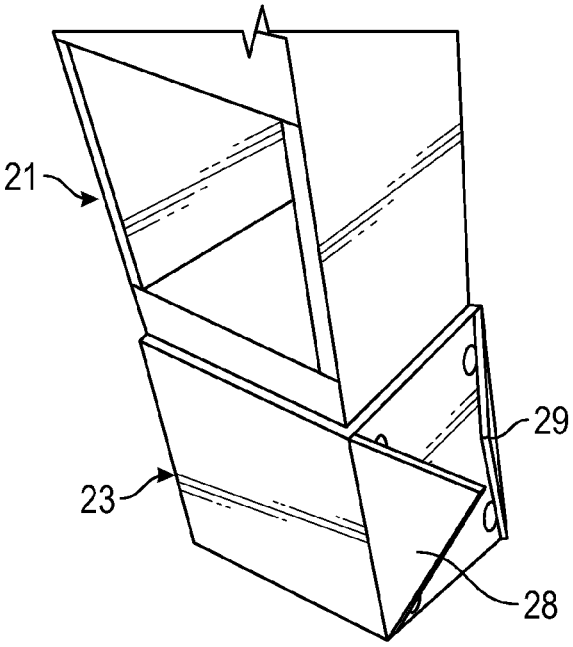
FIG. 40 is a fragmentary top isometric view showing a display tower with the fins on the stabilizing base being unfolded into their operative stabilizing position.
Figure 41:
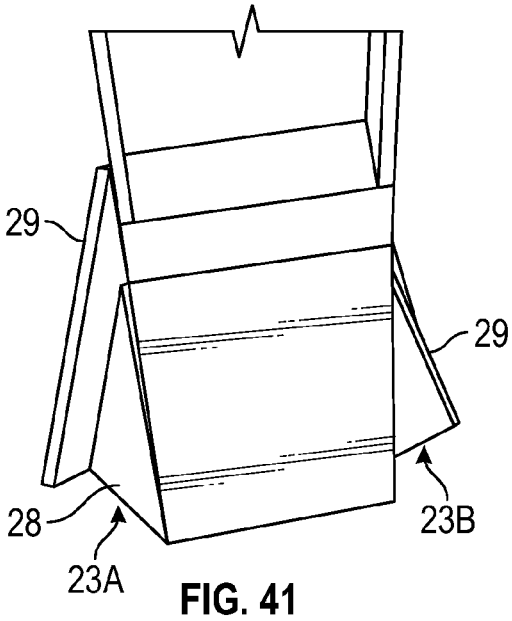
FIG. 41 is a fragmentary top isometric view of a different side of the bottom end of the display tower, showing the fins being unfolded.
Figure 42:
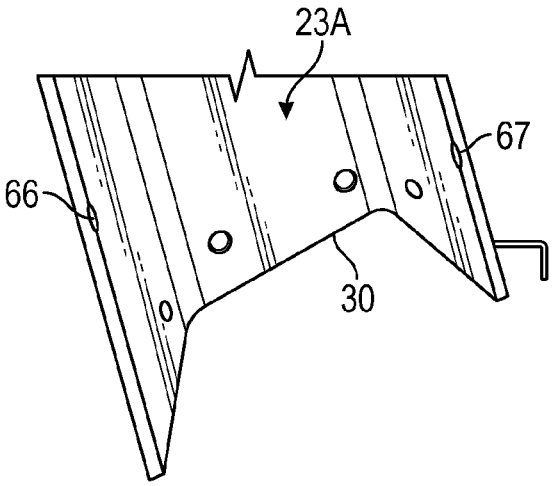
FIG. 42 shows the stabilizing wire being attached to the fins on one of the folding base parts.
Figure 43:
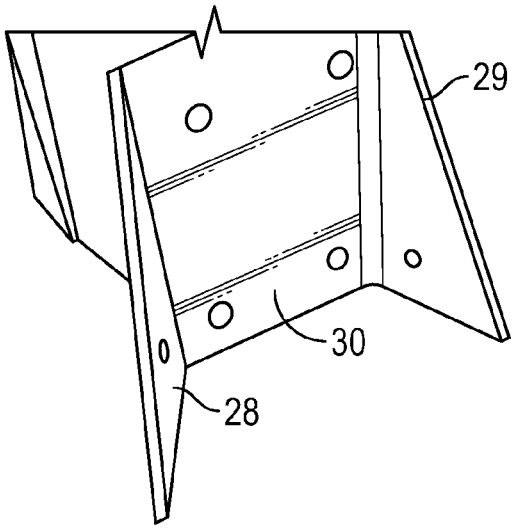
FIG. 43 shows the stabilizing wire in operative position to hold the fins spread apart.
Figure 44:
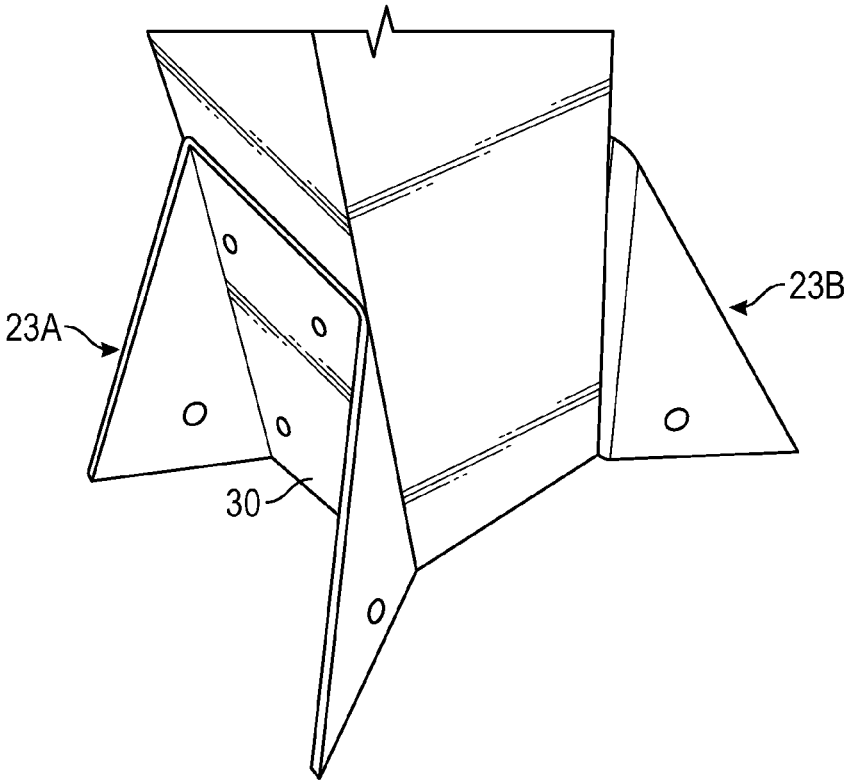
FIG. 44 is a fragmentary isometric view showing the folding base in its operative unfolded condition.

A prior shipping and display container 10 is shown in FIG. 1. The container comprises a relatively narrow elongate tower 11 having generally a U-shape in transverse cross section, with a plurality of vertically spaced shelves 12 supported on the tower. The tower 11 is inserted at its bottom end in a pocket 13 in a pyramid shaped base 14. The container is loaded with product P and placed in a shipping container (not shown, but see FIGS. 38 and 39) for shipment to a retail establishment. Because the shipping container must be sized to accommodate the pyramid shaped base, which is laterally larger than the rest of the display tower, a void space is created around the entire bottom shelf area of the tower, which then requires fillers 15 to stabilize the unit during shipping.

Figure 4:
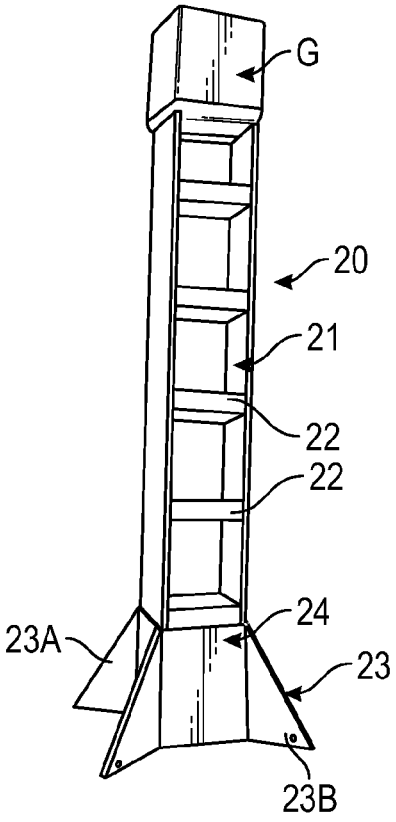
FIG. 4 is a front view of a display tower incorporating the folding base of the invention.
Figure 5:
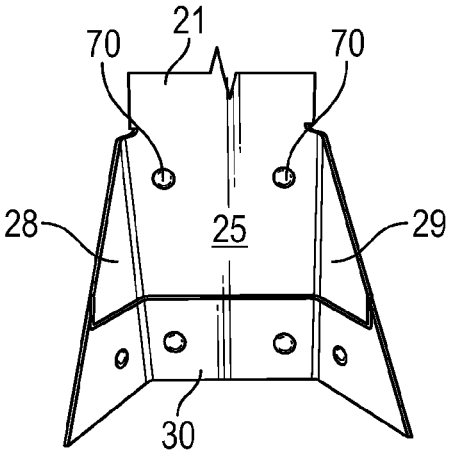
FIG. 5 is an enlarged fragmentary isometric view showing the folding base of the invention attached to the bottom end of a display tower.
Figure 6:
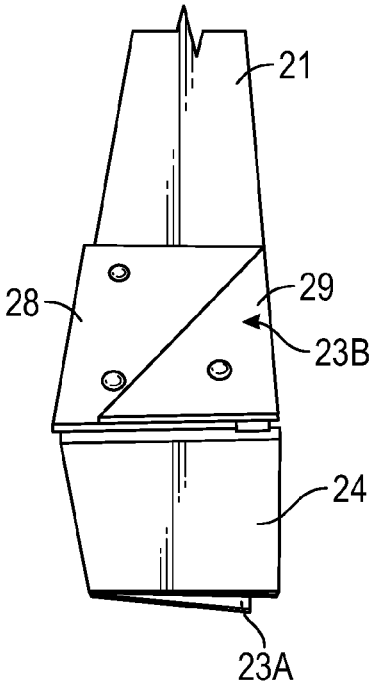
FIG. 6 is an isometric view looking from the bottom end of a display tower, showing the folding base of the invention in its folded position for shipping.
Figure 7:
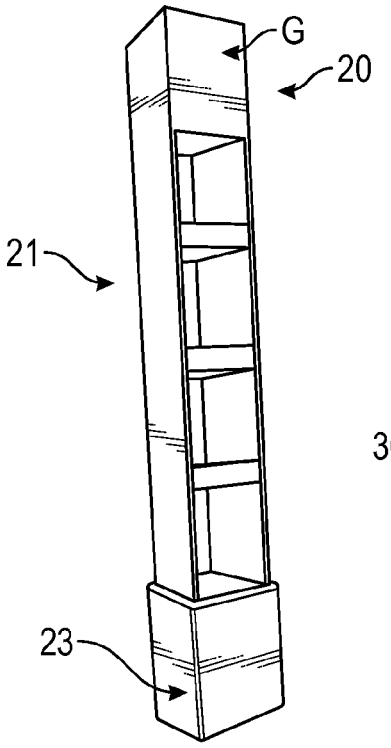
FIG. 7 is a front view of a display tower and base according to the invention, with the base and graphics header folded and wrapped for shipping.
Figure 8:
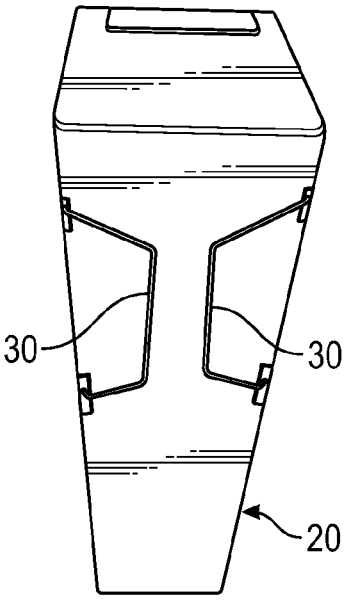
FIG. 8 is an enlarged fragmentary top isometric view of the upper end of the display tower of the invention, showing the stabilizing wires and graphics header in stowed position for shipping.
Figure 9:
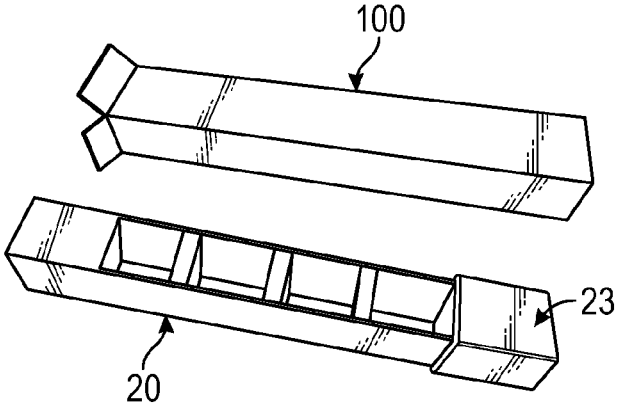
FIG. 9 is an exploded isometric view of a shipping container and the display tower of the invention folded and wrapped for placement in the shipping container.
Figure 10:
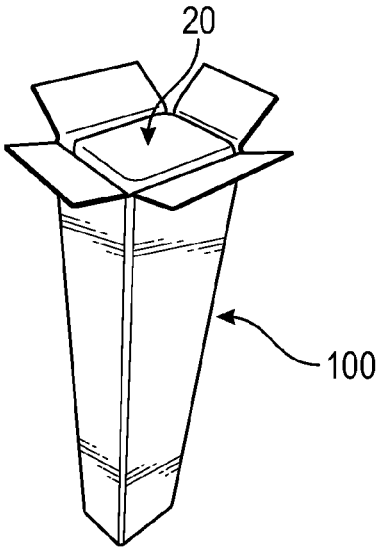
FIG. 10 is a top isometric view of the display tower of the invention loaded in the shipping container.

A shipping and display container according to the invention is shown at 20 in FIG. 4. This container also comprises a relatively narrow elongate tower 21 having generally a U-shape in transverse cross-section, with a plurality of shelves 22 supported on the tower. However, rather than the pyramid shaped base used on the prior container, the invention has a stabilizing base 23 formed of two identical base parts 23A and 23B attached to respective opposite sides of the bottom end 24 of the tower. The base parts each comprise a central panel 25 attached to respective opposite sides 32A and 32B of the bottom end 24, and triangularly shaped fins 28 and 29 projecting diagonally outwardly from opposite sides of the central panel. A stabilizing wire 30 is engaged between the fins to hold them in their outwardly spread positions shown in FIGS. 4 and 5. A graphics header G is shown attached to the top of the tower, but this can be omitted if desired.

As shown in FIGS. 6-10, the fins 28 and 29 are folded flat against the central panel 25 so that the tower and base fit within a shipping container 100 (see FIGS. 9 and 10) without leaving voids and without requiring fillers between the tower and the shipping container.

Figure 11:
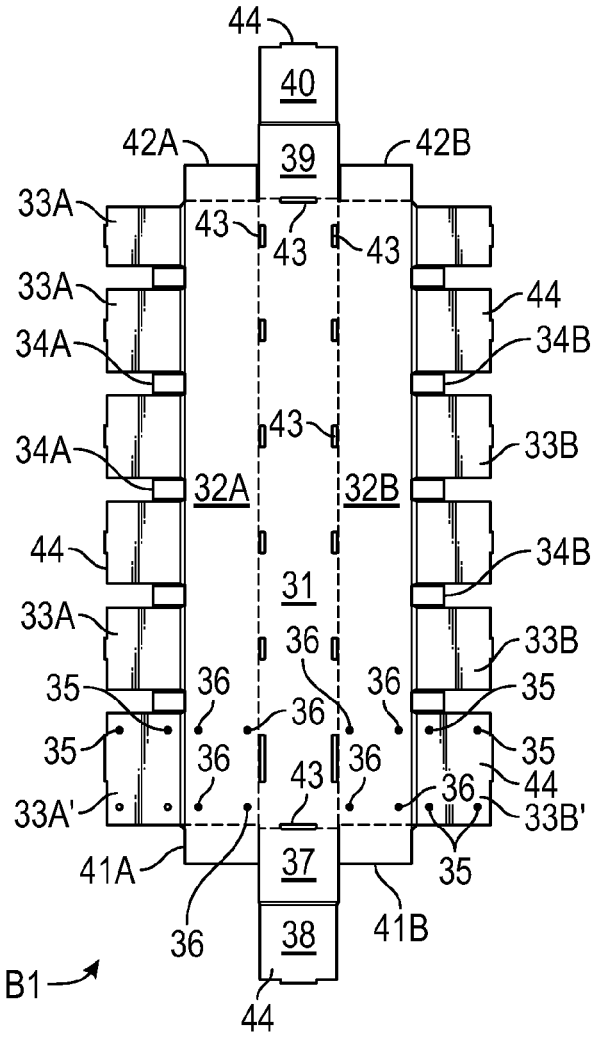
FIG. 11 is a plan view of the blank for making the display tower of the invention.

A blank for making the tower 21 is indicated generally at B1 in FIG. 11. The blank comprises an elongate rectangular back panel 31, opposed side panels 32A and 32B foldably joined to opposite side edges of the back panel, and a plurality of spaced apart side rollover panels 33A and 33B foldably joined to outer side edges of respective side panels. A plurality of tabs 34A and 34B are foldably joined to respective outer side edges of the side panels in locations between the spaced apart side rollover panels 33A and 33B. The side rollover panels 33A' and 33B' at the bottom end of the blank are slightly wider in a direction longitudinally of the blank than the other side rollover panels, and holes 35 are formed through the corners of the panels 33A' and 33B'. Corresponding holes 36 are formed in the bottom ends of the side panels 32A and 32B and these holes are in registry with the holes 35 when the side rollover panels 33A' and 33B' are folded inwardly to lie against the inner surface of the side panels as described hereinafter. A main bottom flap 37 is foldably joined to the bottom end of the back panel, and a bottom rollover panel 38 is foldably joined to the main bottom flap. A main top flap 39 is foldably joined to the upper end of the back panel, and a top rollover panel 40 is foldably joined to the main top flap. Secondary bottom flaps 41A and 41B are foldably joined to the bottom ends of respective side panels, and secondary top flaps 42A and 42B are foldably joined to the upper ends of respective side panels. Slots 43 are formed in the back panel adjacent its folded connection with the side panels and the main top and bottom panels, and locking tabs 44 are formed on the outer end edges of each of the side rollover panels and the top and bottom rollover panels. When the rollover panels are folded inwardly as described hereinafter, the locking tabs engage in respective slots to hold the parts in folded relationship, defining a pocket 45 in the lower end of the tower.

Figure 12:
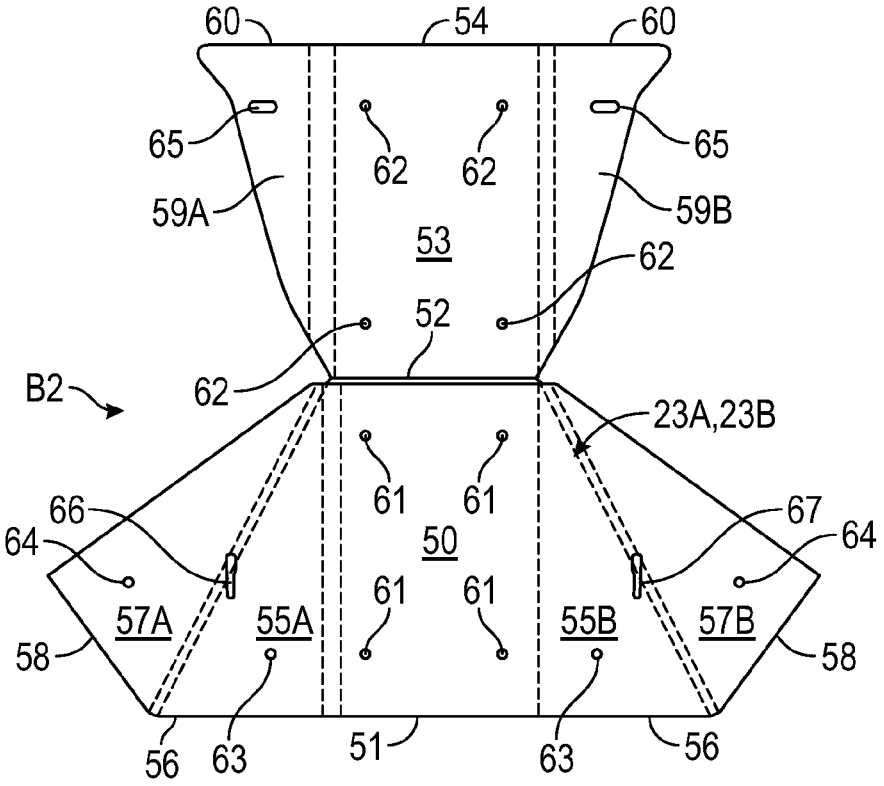
FIG. 12 is a plan view of the blank for making one of the folding finned base parts of the invention.
Figure 13:
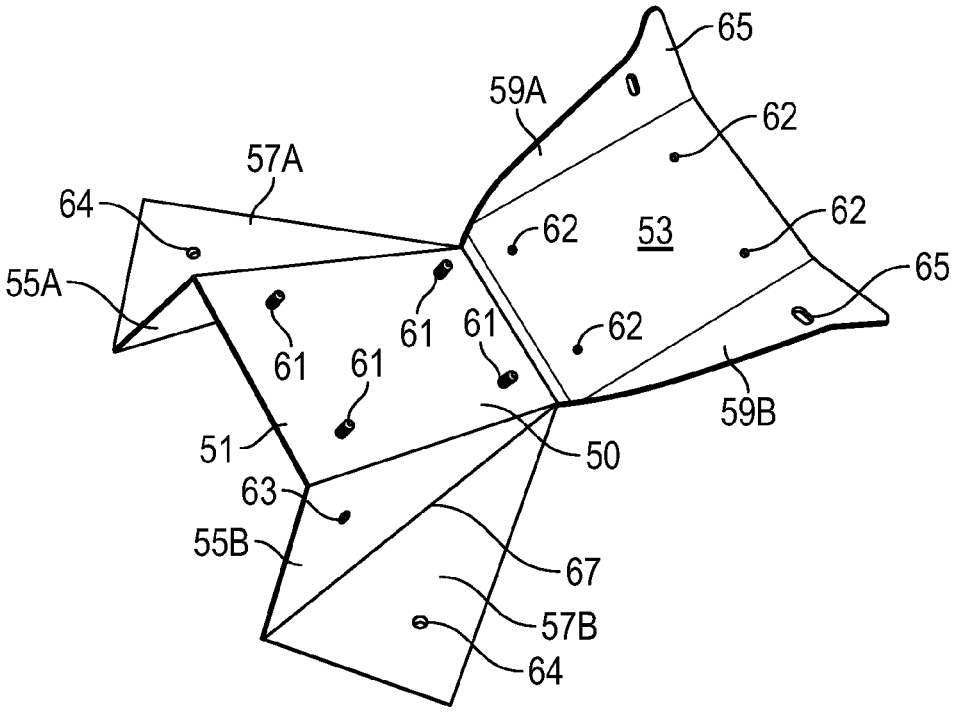
FIG. 13 is an isometric view of one of the folding base parts prior to the part being folded and fastened in its operative condition.
Figure 14:
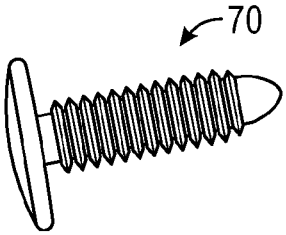
FIG. 14 shows one of the fasteners used to secure the folding base parts in their operative folded condition and to secure the parts to the bottom end of the display tower.
Figure 15:
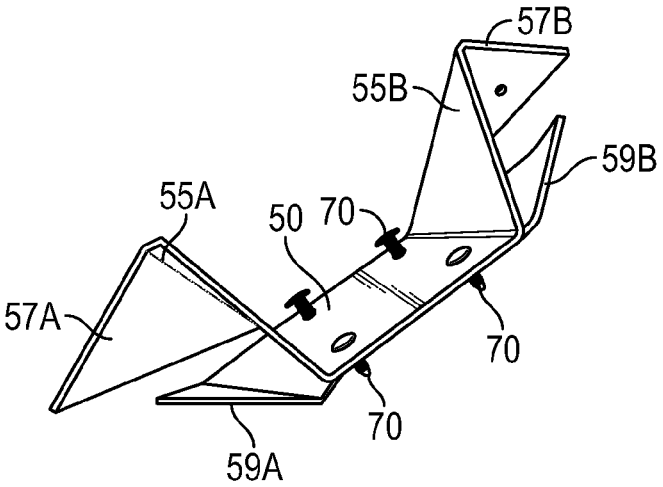
FIG. 15 shows a base part being folded and fastened in its operative condition.
Figure 16:
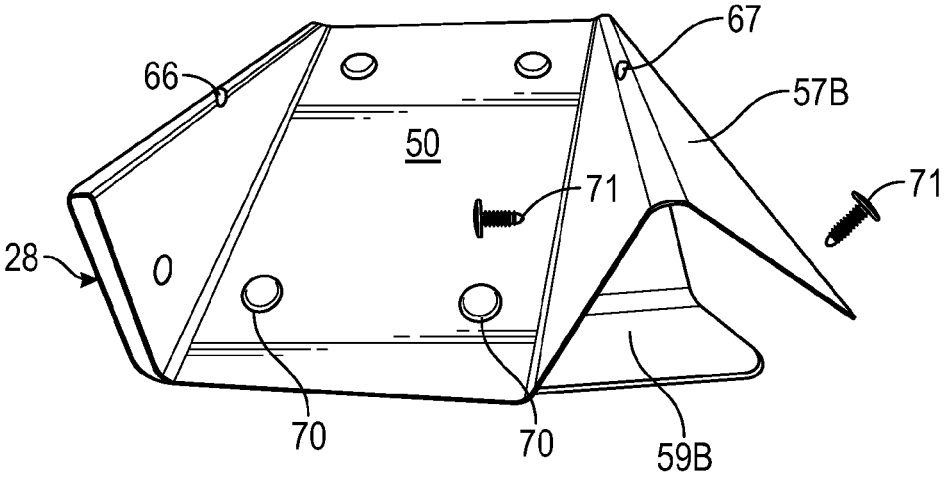
FIGS. 16 and 17 show further steps in folding and securing the base part in its operative condition, wherein the panels forming the fins are folded and fastened together.
Figure 17:
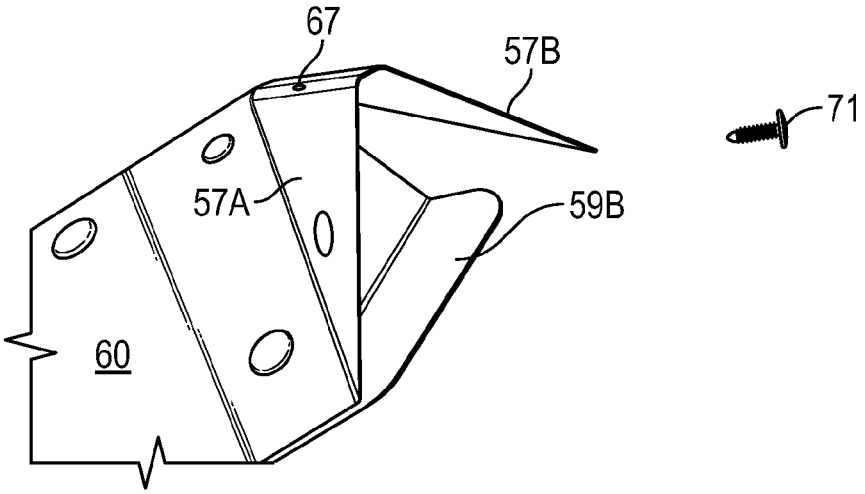

A blank for making one of the stabilizing base parts 23A or 23B is shown at B2 in FIG. 12. The blank comprises a rectangular front panel 50 having a base end 51 and an upper end 52. A back panel 53 substantially identical to the front panel is foldably joined at one end to the upper end 52 of the front panel, and has an opposite free edge 54. First triangularly shaped panels 55A and 55B are foldably joined to respective opposite side edges of the front panel 50, said first panels 55A and 55B each having a wide base end 56 colinear with the base end 51 of the front panel. Second triangularly shaped panels 57A and 57B are foldably joined to respective outer side edges of the first triangularly shaped panels 55A and 55B, said panels 57A and 57B each having a wide base end 58 that is collinear with the ends 51 and 56 when the panels are in their operative folded positions as described hereinafter. Third generally triangularly shaped panels 59A and 59B are foldably joined to respective opposite side edges of the back panel 53, each having an edge 60 collinear with the edge 54 on the back panel. Openings 61 are formed through the corners of the front panel, and openings 62 are formed through the corners of the back panel. The openings 61 and 62 are in aligned registry with one another when the front panel is folded over the back panel as described hereinafter. An opening 63 is formed through each first triangularly shaped panel 55A and 55B approximately midway between their opposite side edges and spaced slightly from the base end 51. A similar opening 64 is formed through each second triangularly shaped panel 57A and 57B approximately midway between their opposite side edges and spaced slightly from their base end 58. When the second triangularly shaped panels are folded over the first triangularly shaped panels as described hereinafter, the openings 63 and 64 are in alignment with one another. The third triangularly shaped panels 59A and 59B each has a slotted opening 65 approximately midway between its opposite side edges. This opening is in aligned registry with the openings 63 and 64 when the panels are in their operative folded positions as described hereinafter. Elongate slots 66 and 67 extending in the length direction of the blank and tapering to a narrower width at their bottom ends are formed at the fold between the first and second triangularly shaped panels for receiving the ends of the stabilizing wire 30 as explained hereinafter.

Figure 18:
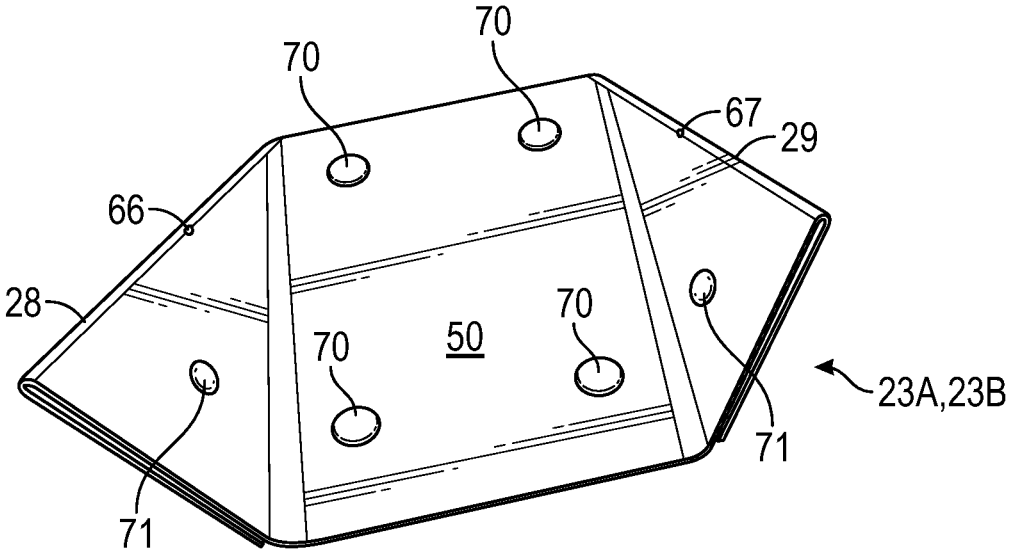
FIG. 18 is an isometric view looking toward the bottom end of one of the fully erected folding base parts.

Erection of one of the stabilizing base parts 23A is depicted in FIGS. 13-18. The front panel 50 is folded over the back panel 53 and barbed fasteners 70 are inserted through the openings 61 and 62 to hold the front panel to the back panel. The first and second triangularly shaped panels 55A, 55B and 57A, 57B, respectively, are partially folded toward one another and the third triangularly shaped panels 59A, 59B are folded upwardly and sandwiched between the first and second triangularly shaped panels. Suitable fasteners 71 are then inserted through the openings 63, 64 and 65 to hold the panels together as shown in FIG. 18. Erection of the other stabilizing base part 23B is identical. Assembly of the stabilizing base parts to the tower 21 will be described hereinafter.

Figure 19:
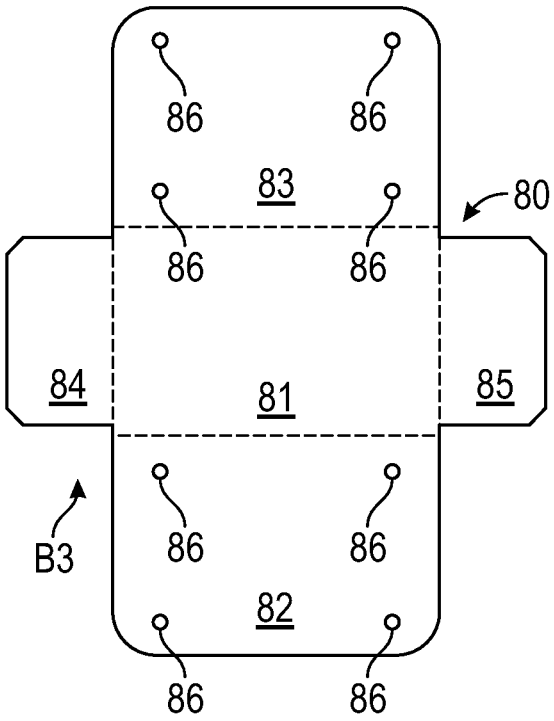
FIG. 19 is a plan view of the blank for making the insert that is placed in the bottom end of the display tower.

A blank B3 for making a reinforcing insert 80 that is placed in the bottom end of the tower is shown in FIG. 19. The blank comprises a center panel 81, opposite side panels 82 and 83 foldably joined to respective opposite sides of the center panel, and opposite end flaps 84 and 85 foldably joined to opposite ends of the center panel. Openings 86 are formed in the corners of each of the side panels and these openings are in aligned registry with the openings 35 and 36 in the tower side panels at the bottom end of the tower when the insert is placed in the tower.

Figure 20:
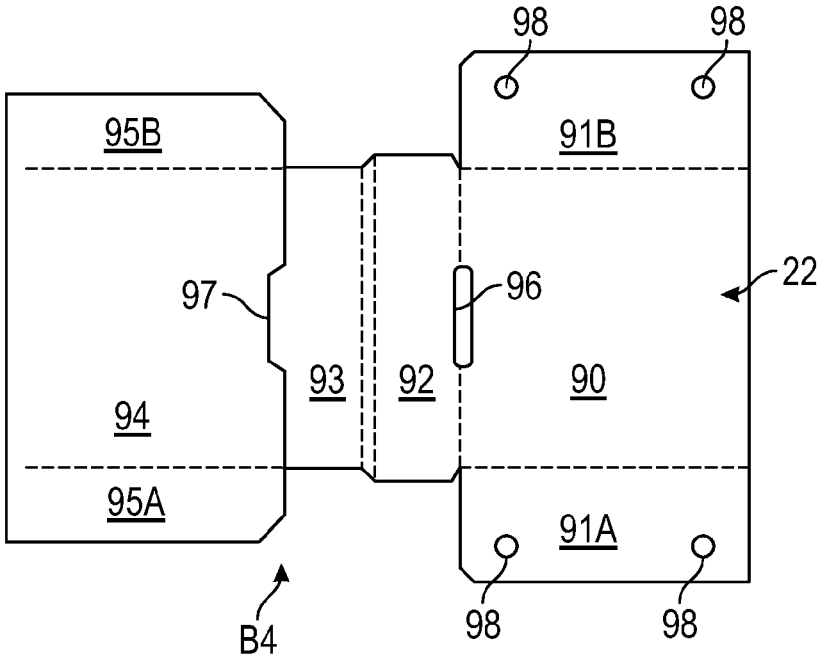
FIG. 20 is a plan view of the blank for making one of the shelves used in the display tower of the invention.

A blank B4 for making one of the shelves 22 used in the tower of the invention is shown in FIG. 20. The blank comprises a bottom panel 90 having first side flaps 91A and 91B foldably joined to respective opposite side edges thereof, an outer front panel 92 foldably joined to one edge of the bottom panel, an inner front panel 93 foldably joined to the outer front panel, a top panel 94 foldably joined to the inner front panel, and second side flaps 95A and 95B foldably joined to opposite side edges thereof. A slot 96 is formed in the bottom panel at the juncture of the bottom panel and the outer front panel, and a locking tab 97 is formed on the edge of the inner front panel where it joins the top panel. This tab locks in the slot 96 when the shelf is in its operative folded position as described hereinafter. Holes 98 are formed through each of the side flaps 91A and 91B adjacent their outer corners for cooperation with the fasteners 70 when the parts are assembled as described hereinafter.

Figure 45:
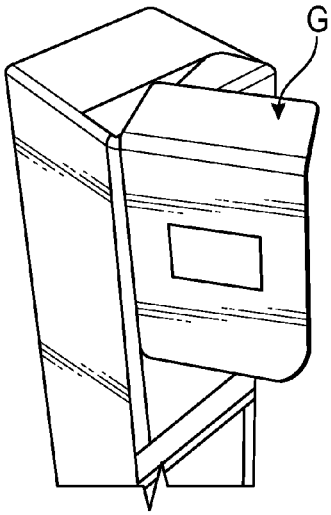
FIGS. 45 and 46 are fragmentary isometric views looking toward the top of the display tower, showing the graphics header being unfolded from its shipping position lying against the side of the tower.
Figure 46:
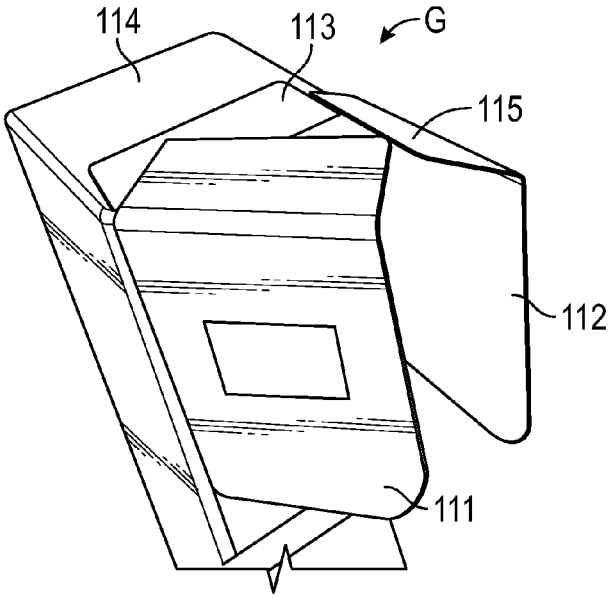
Figure 47:
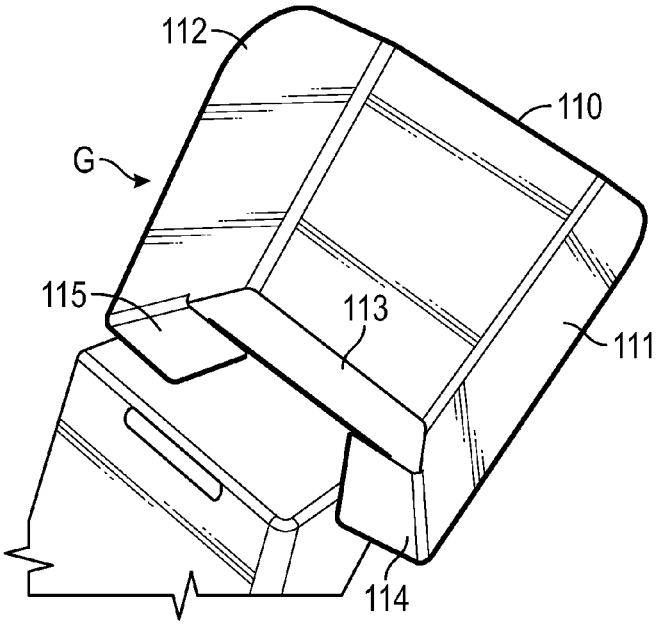
FIG. 47 shows the graphics header nearly in its operative position, with inwardly folded flanges at opposite sides of the bottom of the header being inserted beneath a retaining flap on the bottom of the front of the header.

The graphics header G, as seen best in FIGS. 45-48, comprises a front panel 110 and opposite side panels 111 and 112. An attaching flap 113 is foldably joined to the bottom end of the front panel, and insert flaps 114 and 115 are foldably joined to the bottom ends of respective side panels. The attaching flap is adhered or otherwise secured to the top of the tower 21. During shipment, the front panel is folded downwardly to lie against the front of the tower, and the side panels are folded inwardly over the front panel, with the insert flaps lying flat on top of the attaching flap. At the point of purchase, the front and side flaps are raised to an upright position as shown in FIG. 47 and the insert flaps 114 and 115 are inserted beneath the attaching flap, opposite end portions of which are left unattached to the top of the tower to provide a space for insertion of the insert flaps. Insertion of the insert flaps beneath the attaching flap holds the header in it upright position.

Figure 21:
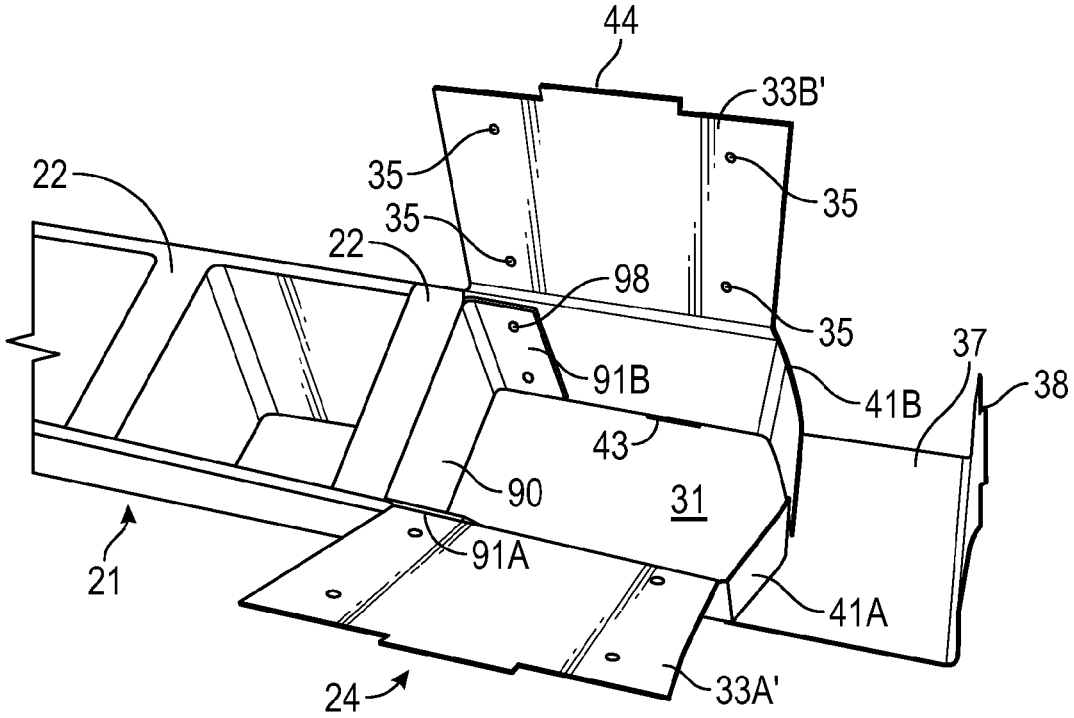
FIG. 21 is an isometric view showing the bottom end of the display tower of the invention unfolded.

Assembly of the stabilizing base to the display tower is best explained with reference to FIGS. 21-33. FIG. 21 illustrates the bottom end 24 of the tower opened up, showing the position of the first side flaps 91A, 91B and the openings 98 therethrough in relation to the rollover panels 33A', 33B' and the openings 35 through those panels.

Figure 22:
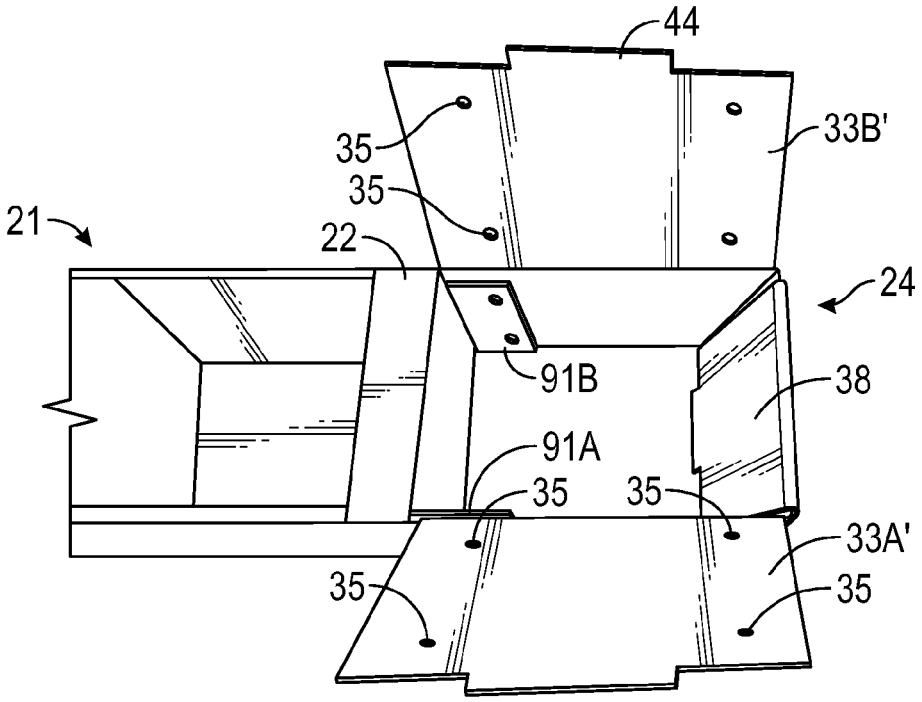
FIG. 22 is an isometric view showing the bottom end of the display tower of the invention partially folded into its operative condition.

FIG. 22 is a view similar to FIG. 21, but showing the rollover flap 38 on the bottom of the tower folded inwardly over the secondary bottom flaps 41A and 41B.

Figure 23:
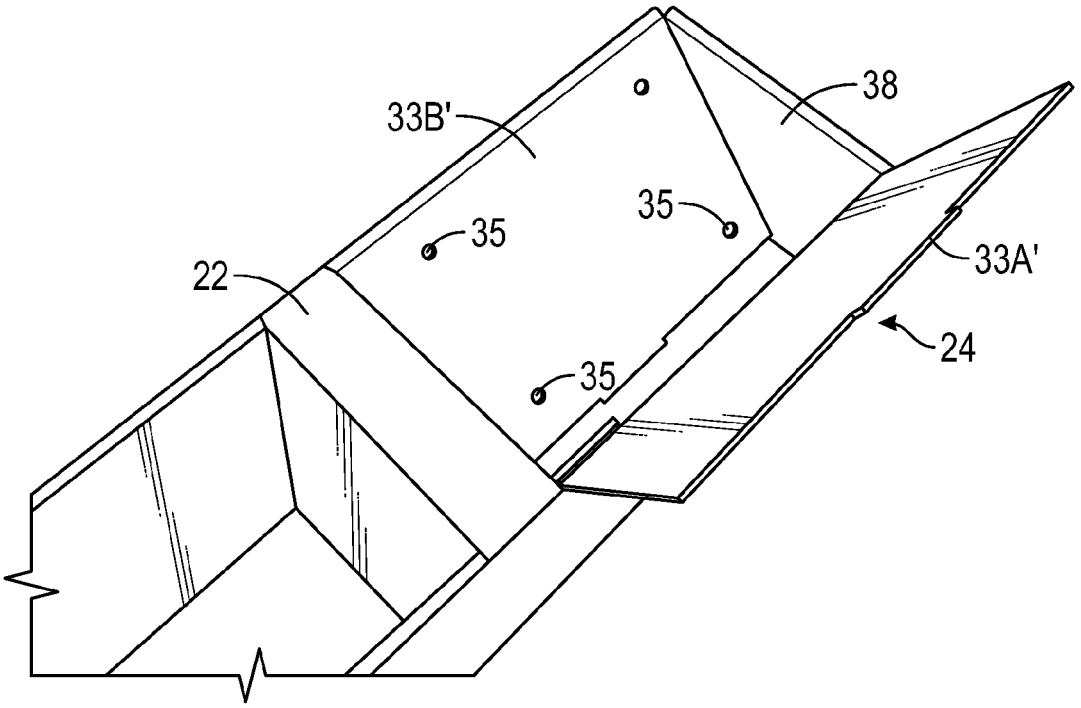
FIG. 23 is an isometric view showing the bottom end of the display tower of the invention in a further folded condition.

FIG. 23 is a view similar to FIGS. 21 and 22, but shows one of the rollover flaps 33B' being folded into operative position.

Figure 24:
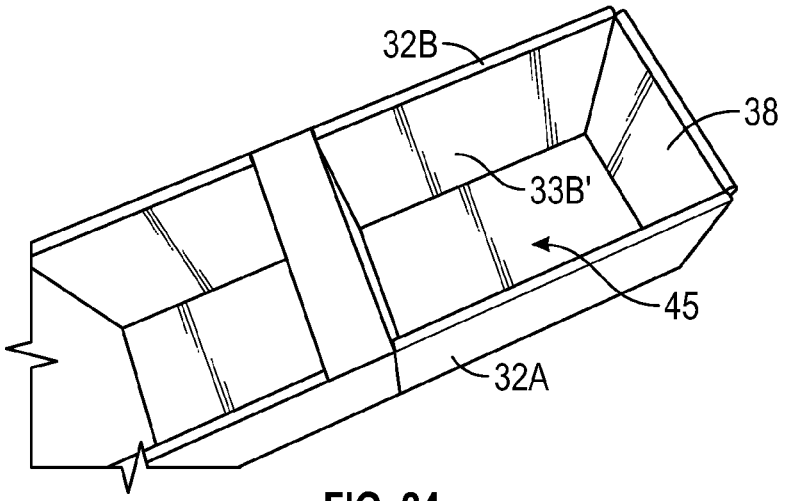
FIG. 24 is an isometric view showing the pocket formed by the fully folded bottom end of the display tower of the invention.
Figure 25:
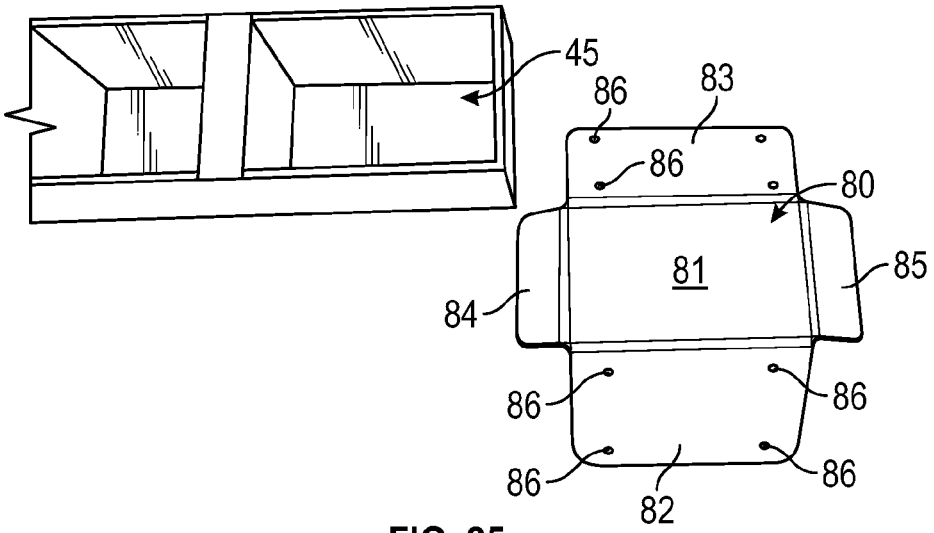
FIG. 25 is an exploded isometric view showing the fully folded bottom end of the display tower and the insert prior to being placed in the pocket.

FIG. 24 is a view similar to FIG. 23, but shows all of the rollover flaps and bottom flaps folded into their operative positions, forming the pocket 45 in the bottom end of the tower, and FIG. 25 shows an insert 80 to be inserted in the pocket 45.

Figure 26:
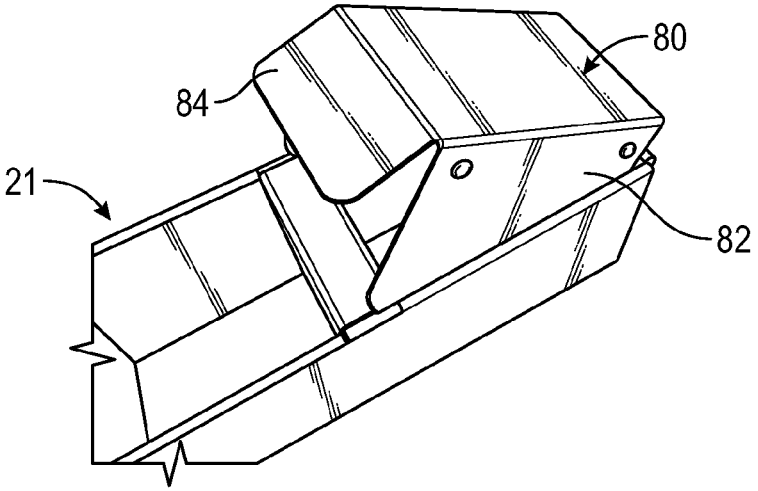
FIG. 26 is an isometric view showing the insert being positioned in the pocket in the bottom end of the tower.
Figure 27:
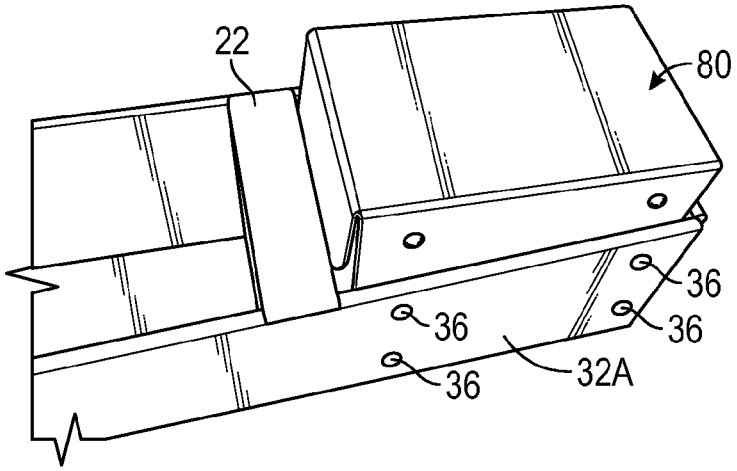
FIG. 27 is an isometric view showing the insert being nearly fully positioned in the pocket.
Figure 28:
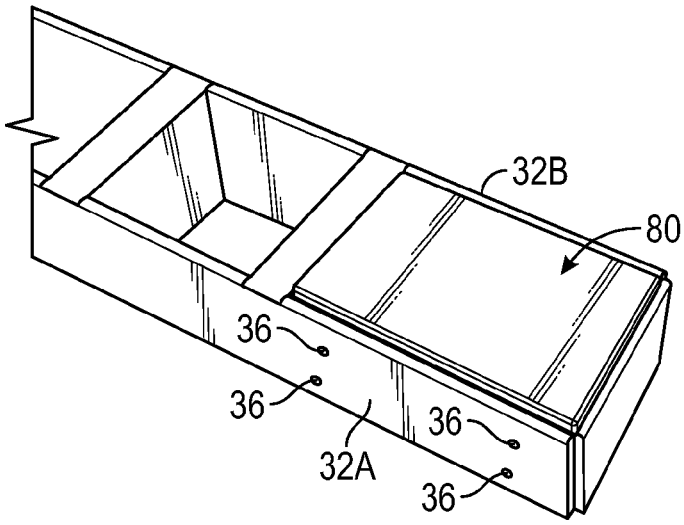
FIG. 28 is an isometric view showing the insert fully positioned in the pocket in the bottom end of the tower.

FIGS. 26 and 27 show the insert 80 being positioned in the pocket, and FIG. 28 shows the insert in position. The insert is positioned so that the holes 86 in the side flaps 82 and 83 are in aligned registry with the holes 36 in the side 32A of the tower, and thus in aligned registry with the holes 35 in the rollover panel 32A'. Thus, the barbed fasteners 70 in the stabilizing base parts 23A and 23B extend through five layers of material, including the panels 50 and 53 of the stabilizing base part, the side 32A or 32B and associated rollover flap 33A' or 33B' of the tower, and side panel 82 or 83 of the insert.

Figure 29:
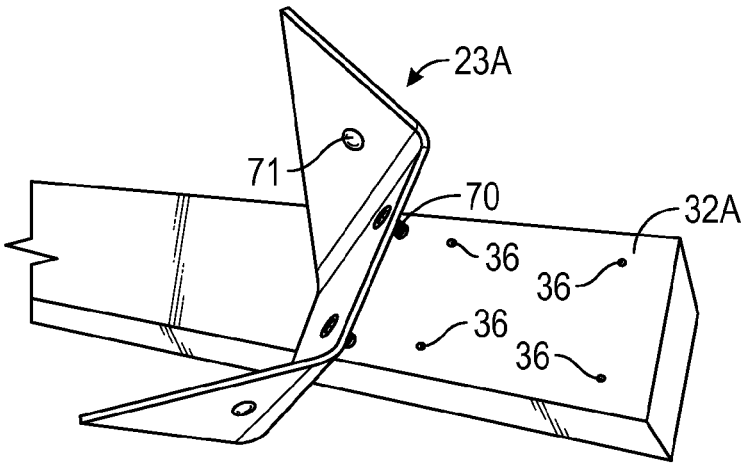
FIG. 29 depicts one of the base parts being positioned for attachment to the bottom end of the display tower.
Figure 30:
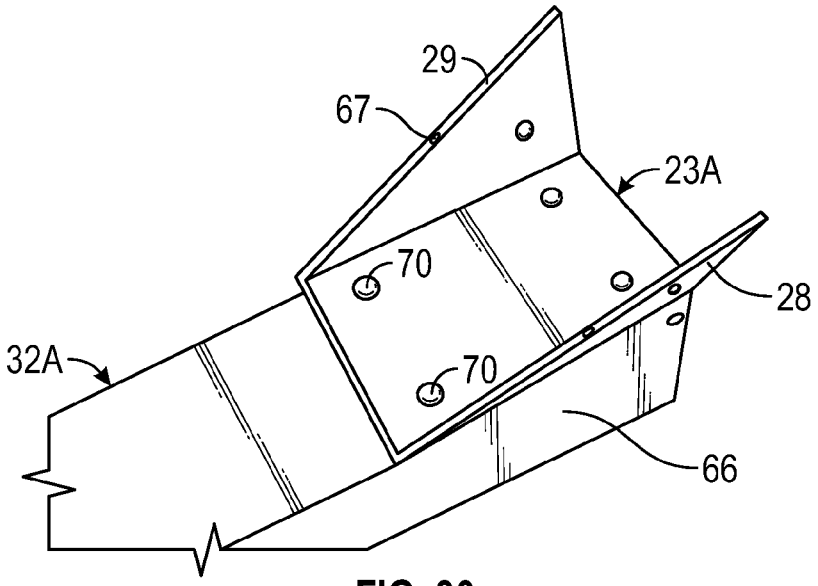
FIG. 30 shows the base part attached to the bottom end of the display tower.
Figure 31:
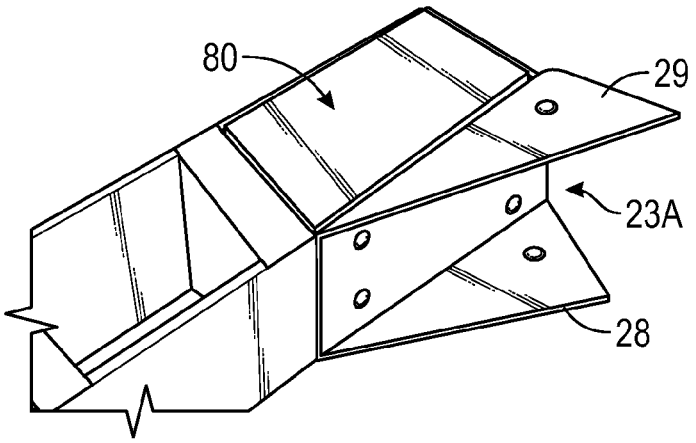
FIG. 31 is a view similar to FIG. 26 but rotated 90° relative to FIG. 30 and showing that the base part is attached to a side of the bottom end of the tower adjacent to the side having the pocket in which the insert is placed.

FIG. 29 shows one of the stabilizing base parts 23A being positioned for insertion of the barbed fasteners 70 through the holes 36 in the side 32A of the tower, and FIGS. 30 and 31 show the stabilizing base part 23A in secured position on the side 32A of the tower.

Figure 32:
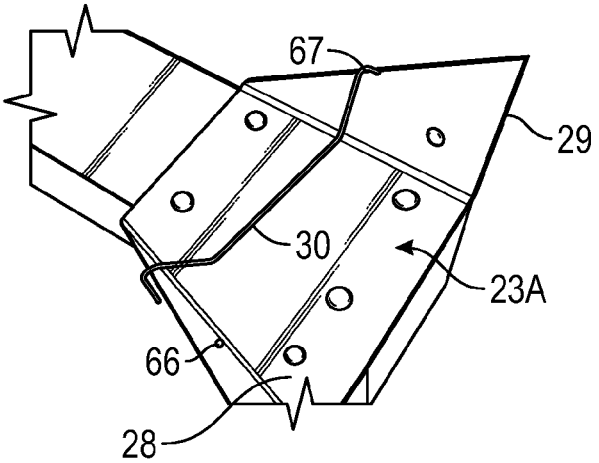
FIG. 32 is an enlarged fragmentary isometric view of the bottom end of a display tower according to the invention, showing a stabilizing wire being positioned for insertion into slots in the fins to hold the fins in their spread positions.
Figure 33:
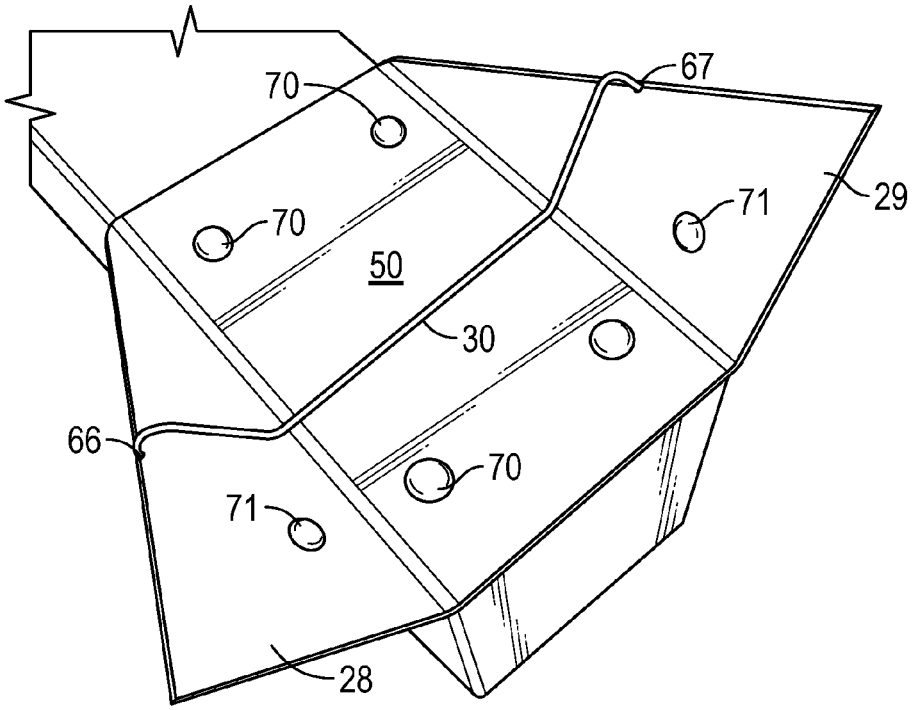
FIG. 33 shows the stabilizing wire fully positioned.

FIG. 32 shows the stabilizing wire 30 being positioned for insertion of its opposite ends in the slots 66 and 67, and FIG. 33 shows the stabilizing wire fully inserted in the slots to hold the fins 28 and 29 in spread positions.

Figure 34:
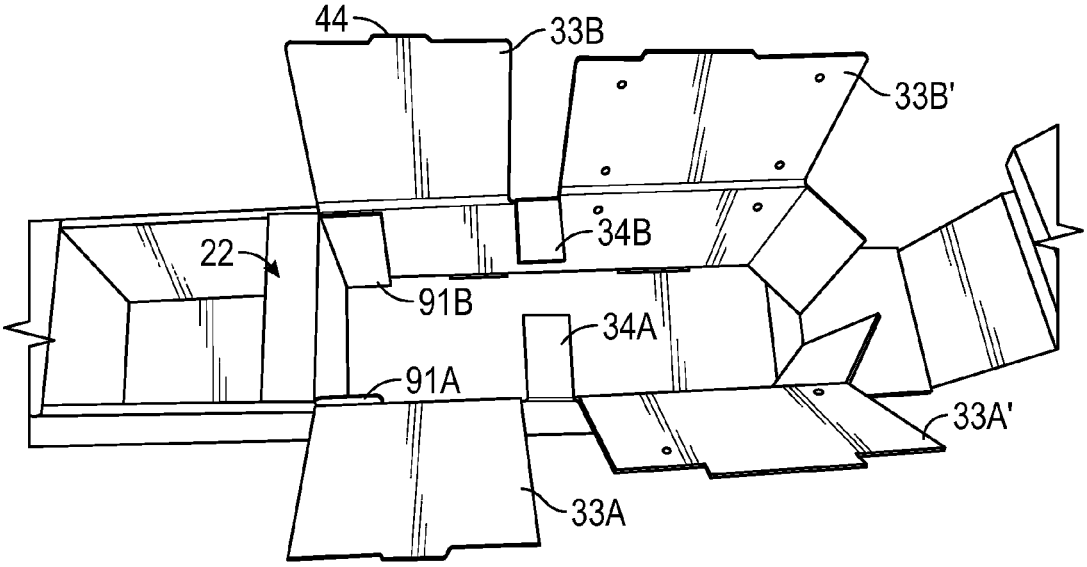
FIG. 34 is a fragmentary view showing the bottom end of the display tower in an unfolded condition.
Figure 35:
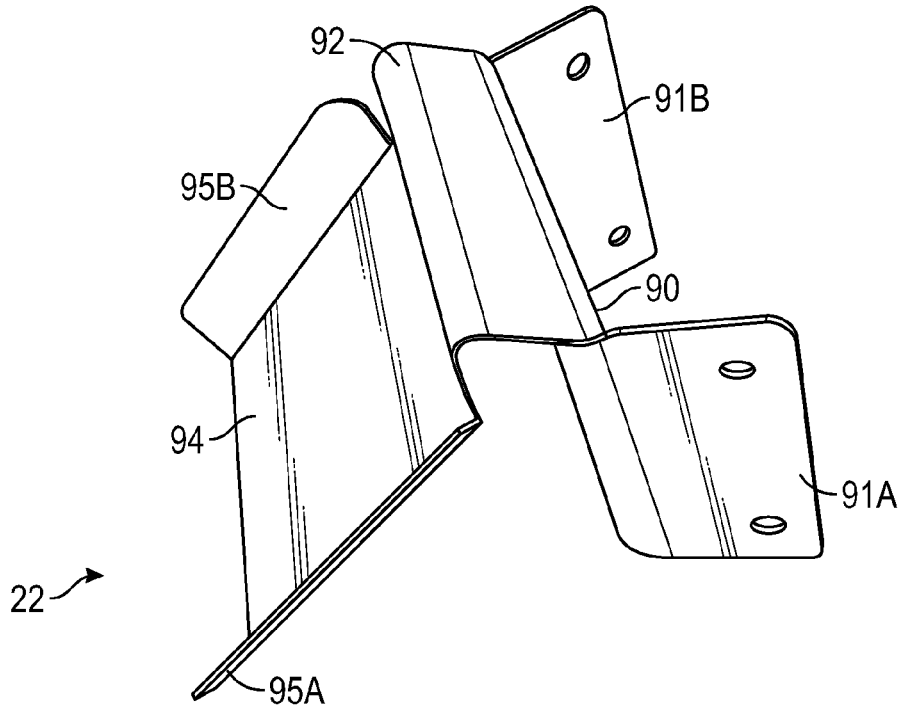
FIG. 35 shows one of the shelves used in the display tower of the invention in a partially folded condition.
Figure 36:
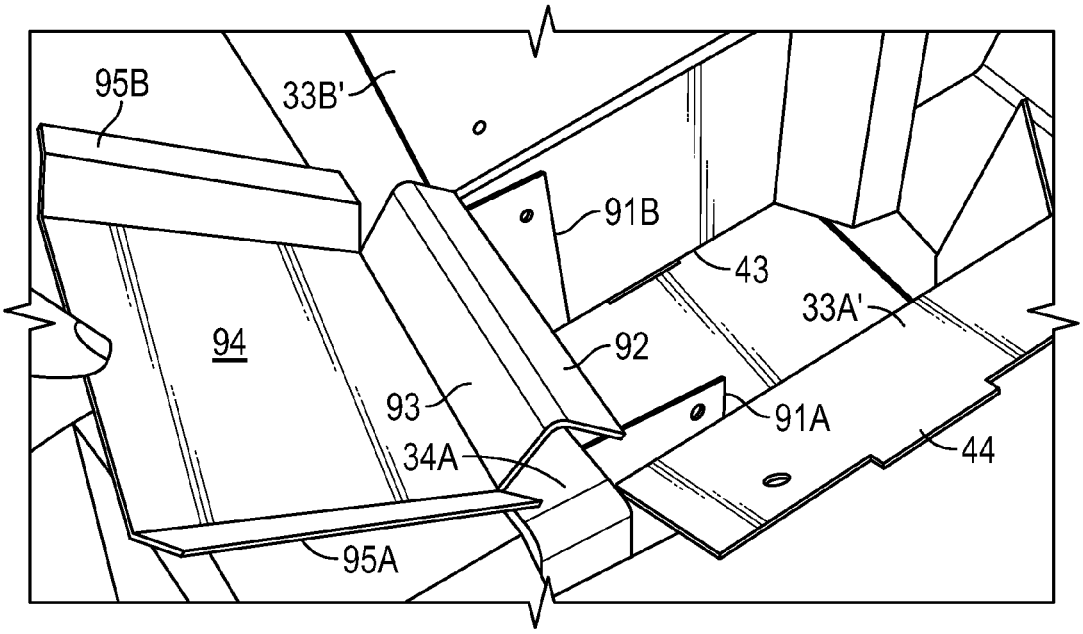
FIG. 36 shows the shelf being positioned over two of the opposed inwardly folded tabs on the tower.
Figure 37:
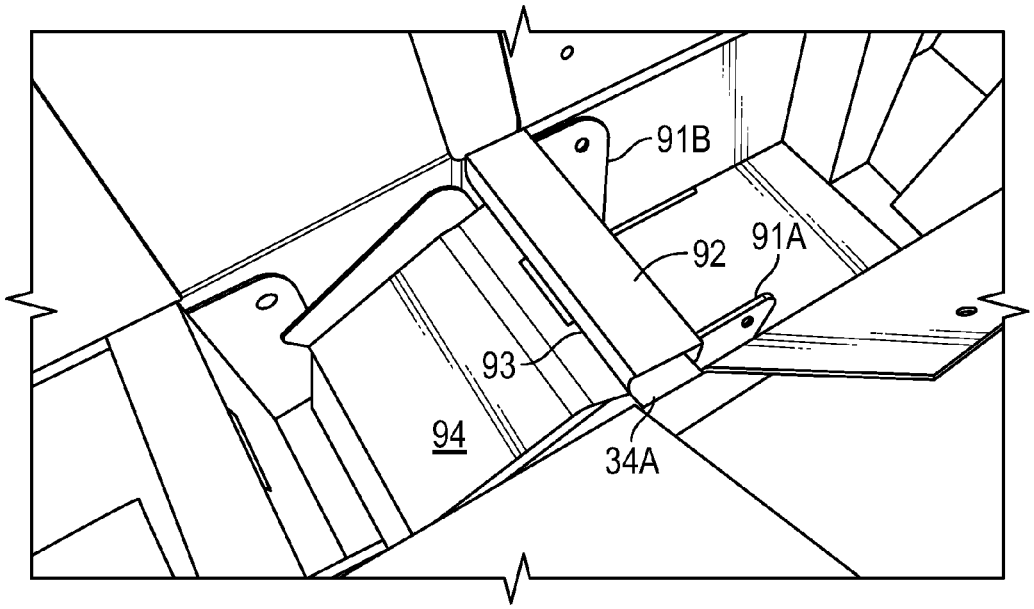
FIG. 37 shows the shelf in a further folded condition over the tabs.

FIGS. 34 through 39 depict the steps involved in securing a shelf 22 in place in the tower 21. FIG. 34 shows the locations of the tabs 34A, 34B and rollover panels 33A, 33B on the tower relative to the side flaps 91A, 91B and front and rear panels 92, 93 on the shelf. The shelf, in a partially folded condition as shown in FIG. 35, is placed so that the bottom panel 90 is below the tabs 34A, 34B and is then folded around the tabs 34A, 34B so that the tabs are captured between the front and rear panels 92 and 93, with the top panel 94 lying on top of the bottom panel 90 and the side flaps 91A, 91B lying along the inner surface of a respective side 32A or 32B of the tower. The rollover flaps 33A' and 33B' are then folded inwardly to capture the side flaps 91A and 91B between the respective sides 32A, 32B and the rollover panels. The tabs 44 on the rollover panels are then inserted into the slots 43 to hold the parts in the folded relationship.

FIGS. 40 through 44 show the wings 28 and 29 on the stabilizing base parts 23A and 23B being folded out and secured in their spread positions by the stabilizing wires 30.

Figure 48:
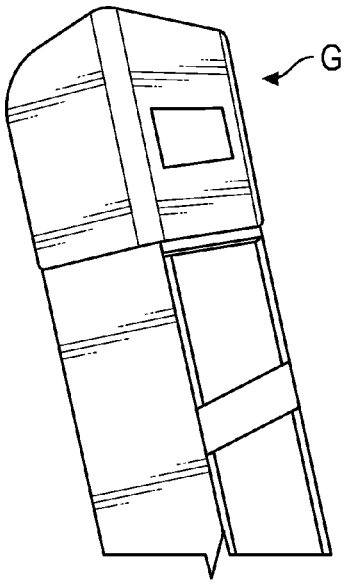
FIG. 48 shows the graphics header in its operative position for display at a point of sale.

Erection of the graphics header G is depicted in FIGS. 45 through 48. In FIGS. 45 and 46 the header is shown being unfolded from its shipping position folded flat against the side of the tower. FIG. 47 shows the front panel 110 of the header folded to an upright position, with the side panels 111 and 112 folded toward the rear of the front panel so that the insert flaps 114, 115 slide beneath the attaching flap 113. Frictional engagement between the attaching flap and the insert flaps holds the graphics header in an upright position as shown in FIG. 48.

While particular embodiments of the invention have been illustrated and described in detail herein, it should be understood that various changes and modifications may be made in the invention without departing from the spirit and intent of the invention as defined by the appended claims.

What is claimed is:

1. A shipping and display container, comprising:

an elongate display tower having an upper end, a lower end, and a plurality of vertically spaced shelves supported thereon, said tower comprises a back panel, opposite side panels foldably joined along a first edge to respective opposite sides of said back panel, rollover panels foldably joined to an edge of a respective said side panel opposite said first edge, and tabs foldably joined to said side panels in locations between said rollover panels, and said shelves have front and rear panels that capture said tabs between them, and side flaps that are captured between said side panels and said rollover panels; and a stabilizing base on the lower end of the tower to support the tower in an upright position on a support surface, said base having a first position folded against the tower so that the base has a small footprint for shipping, and a second position unfolded to a larger footprint to define a support for stabilizing the tower in an upright position at a point of purchase.

2. A shipping and display container of claim 1, wherein: the stabilizing base is a separate part attached to the lower end of the tower.

3. A shipping and display container of claim 1, wherein: the stabilizing base comprises two separate parts attached to the lower end of the tower, said parts being attached to respective opposite sides of the tower.

4. A shipping and display container of claim 1, wherein: the stabilizing base comprises two separate parts attached to the lower end of the tower, said parts being attached to respective opposite sides of the tower and each comprising a back panel and an overlying front panel, first triangularly shaped panels foldably attached to respective opposite side edges of the front panel, second triangularly shaped panels foldably attached to outer side edges of the first triangularly shaped panels, and third triangularly shaped panels foldably attached to respective opposite side edges of the back panel, said third triangularly shaped panels being captured between said first and second triangularly shaped panels.

5. A shipping and display container of claim 1, wherein:

the stabilizing base comprises two separate parts attached to the lower end of the tower, said parts being attached to respective opposite sides of the tower and each comprising a back panel and an overlying front panel, first triangularly shaped panels foldably attached to respective opposite side edges of the front panel, second triangularly shaped panels foldably attached to outer side edges of the first triangularly shaped panels, and third triangularly shaped panels foldably attached to respective opposite side edges of the back panel, said third triangularly shaped panels being captured between said first and second triangularly shaped panels;

first fasteners extended through the front and back panels to hold them in overlying contiguous relationship to one another; and second fasteners extended through the first, second and third triangularly shaped panels to hold them in overlying contiguous relationship to one another.

6. A shipping and display container of claim 1, wherein:

the stabilizing base comprises two separate parts attached to the lower end of the tower, said parts being attached to respective opposite sides of the tower and each comprising a back panel and an overlying front panel, first triangularly shaped panels foldably attached to respective opposite side edges of the front panel, second triangularly shaped panels foldably attached to outer side edges of the first triangularly shaped panels, and third triangularly shaped panels foldably attached to respective opposite side edges of the back panel, said third triangularly shaped panels being captured between said first and second triangularly shaped panels;

first fasteners extended through the front and back panels to hold them in overlying contiguous relationship to one another;

second fasteners extended through the first, second and third triangularly shaped panels to hold them in overlying contiguous relationship to one another; and said first fasteners extended through said side panels and said rollover panels.

7. A shipping and display container of claim 1, wherein:

the stabilizing base comprises two separate parts attached to the lower end of the tower, said parts being attached to respective opposite sides of the tower and each comprising a back panel and an overlying front panel, first triangularly shaped panels foldably attached to respective opposite side edges of the front panel, second triangularly shaped panels foldably attached to outer side edges of the first triangularly shaped panels, and third triangularly shaped panels foldably attached to respective opposite side edges of the back panel, said third triangularly shaped panels being captured between said first and second triangularly shaped panels;

first fasteners extended through the front and back panels to hold them in overlying contiguous relationship to one another;

second fasteners extended through the first, second and third triangularly shaped panels to hold them in overlying contiguous relationship to one another; and openings are formed through said stabilizing base front and back panels and through said tower side panels and rollover panels, said openings being in aligned registry with one another and said first fasteners extended through said openings.

8. A shipping and display container of claim 1, wherein:

said stabilizing base has outwardly extending triangularly shaped fins at opposite corners of said tower, said fins being foldable to said first position and unfolded to said second position.

9. A shipping and display container of claim 1, wherein:

the stabilizing base comprises two separate stabilizing base parts attached to the lower end of the tower, said stabilizing base parts being attached to respective opposite sides of the tower; and triangularly shaped fins extend outwardly from opposite side edges of each said stabilizing base part so that a fin extends diagonally outwardly from opposite corners of said tower, said fins being foldable to said first position and unfolded to said second position.

10. A shipping and display container of claim 1, wherein:

the stabilizing base comprises two separate stabilizing base parts attached to the lower end of the tower, said stabilizing base parts being attached to respective opposite sides of the tower; and said stabilizing base parts each comprises a back panel and an overlying front panel, first triangularly shaped panels foldably attached to respective opposite side edges of the front panel, second triangularly shaped panels foldably attached to outer side edges of the first triangularly shaped panels, and third triangularly shaped panels foldably attached to respective opposite side edges of the back panel, said third triangularly shaped panels being captured between said first and second triangularly shaped panels;

first fasteners extended through the front and back panels to hold them in overlying contiguous relationship to one another;

second fasteners extended through the first, second and third triangularly shaped panels to hold them in overlying contiguous relationship to one another; and openings are formed through said stabilizing base front and back panels and through said tower side panels and rollover panels, said openings being in aligned registry with one another and said first fasteners extended through said openings.

11. A shipping and display container of claim 1, wherein:

the stabilizing base comprises two separate stabilizing base parts attached to the lower end of the tower, said stabilizing base parts being attached to respective opposite sides of the tower; and said stabilizing base parts each comprises a back panel and an overlying front panel, first triangularly shaped panels foldably attached to respective opposite side edges of the front panel, second triangularly shaped panels foldably attached to outer side edges of the first triangularly shaped panels, and third triangularly shaped panels foldably attached to respective opposite side edges of the back panel, said third triangularly shaped panels being captured between said first and second triangularly shaped panels;

first fasteners extend through the front and back panels to hold them in overlying contiguous relationship to one another;

second fasteners extend through the first, second and third triangularly shaped panels to hold them in overlying contiguous relationship to one another;

said first fasteners extended through said side panels and said rollover panels;

openings are formed through said stabilizing base front and back panels and through said tower side panels and rollover panels, said openings being in aligned registry with one another and said first fasteners extended through said openings; and triangularly shaped fins extend outwardly from opposite side edges of each said stabilizing base part so that a fin extends diagonally outwardly from opposite corners of said tower, said fins being foldable to said first position and unfolded to said second position.

12. A shipping and display container of claim 1, wherein:

the stabilizing base comprises two separate stabilizing base parts attached to the lower end of the tower, said stabilizing base parts being attached to respective opposite sides of the tower; and said stabilizing base parts each comprises a back panel and an overlying front panel, first triangularly shaped panels foldably attached to respective opposite side edges of the front panel, second triangularly shaped panels foldably attached to outer side edges of the first triangularly shaped panels, and third triangularly shaped panels foldably attached to respective opposite side edges of the back panel, said third triangularly shaped panels being captured between said first and second triangularly shaped panels;

first fasteners extend through the front and back panels to hold them in overlying contiguous relationship to one another;

second fasteners extend through the first, second and third triangularly shaped panels to hold them in overlying contiguous relationship to one another;

said first fasteners extended through said side panels and said rollover panels;

openings are formed through said stabilizing base front and back panels and through said tower side panels and rollover panels, said openings being in aligned registry with one another and said first fasteners extended through said openings;

triangularly shaped fins extend outwardly from opposite side edges of each said stabilizing base part so that a fin extends diagonally outwardly from opposite corners of said tower, said fins being foldable to said first position and unfolded to said second position; and said first fasteners are barbed fasteners and said second fasteners are threaded fasteners.

* * * * *